United States Patent [19]

Monahan et al.

[11] Patent Number: 4,480,212

[45] Date of Patent: Oct. 30, 1984

[54] EXTENDED LIFE INCANDESCENT LAMP WITH SELF CONTAINED DIODE AND REFLECTOR

[75] Inventors: Russell Monahan, Ypsilanti; Kevin J. Keating, Birmingham, both of Mich.

[73] Assignee: Diolight Technology, Inc., Bloomfield Hills, Mich.

[21] Appl. No.: 387,737

[22] Filed: Jun. 14, 1982

[51] Int. Cl.[3] ..... H01K 1/62

[52] U.S. Cl. ..... 315/71; 313/113; 315/200 R

[58] Field of Search ..... 315/71, 200 R; 313/113

[56] References Cited

U.S. PATENT DOCUMENTS 1,305,837 6/1919 Sedano ..... 313/113

1,657,060 1/1928 Becket ..... 313/113 X 3,869,631 3/1975 Anderson et al. ..... 315/71 X

*Primary Examiner*—Eugene R. LaRoche

*Attorney, Agent, or Firm*—Reising, Ethington, Barnard, Perry & Milton

[57] ABSTRACT

An incandescent lamp is disclosed having an extended operating life with a high operating efficiency in terms of lumens per watt. The lamp incorporates a rectifying diode in series with the filament and the filament has an operating temperature less than 2550° C. A reflector is mounted in the neck portion of the lamp for reflecting visible light outwardly through the bulb portion of the envelope and for minimizing convection currents in the base of the lamp. The diode is disposed between the reflector and the lamp base.

6 Claims, 3 Drawing Figures

EXTENDED LIFE INCANDESCENT LAMP WITH SELF CONTAINED DIODE AND REFLECTOR

FIELD OF THE INVENTION

This invention relates to incandescent lamps of the type commonly used in lighting fixtures of houses and other dwellings. More particularly, it relates to improvements in such lamps for providing extended lamp life and greater operating efficiency.

BACKGROUND ART

The conventional incandescent lamp used for home lighting is commonly known as the A-line gas filled lamp having a wattage between about 40 and 150 watts. The construction parameters for such lamps are substantially uniform among different manufacturers, the lamps being designed for operation from a nominal voltage of 120 volts, 60 cycle AC with standard power ratings of 40, 60, 75, 100 and 150 watts. Such lamps are rated for average operating life and for standard lamps a rated life of 1,000 hours or less is typical. For convenience, these may be termed short-life lamps as compared with known lamps having extended life ranging upward from 1,000 hours to several years. In general, life of a given lamp may be increased by operating the tungsten filament at a reduced temperature. This can be achieved by changing the design of the filament. A typical 100 watt lamp has a coiled tungsten wire filament of 0.0635 mm diameter and an uncoiled length of 577 mm. It has an operating temperature of 2577° C. and an average operating life of 750 hours. The life of this lamp could be increased while retaining the same wattage rating by changing the filament configuration so that it operates at a lower temperature; however, the efficiency in terms of lumens per watt would be decreased.

Another way of extending the operating life of an incandescent lamp is to reduce the effective voltage across the filament. This has been done in the prior art by connecting a rectifying diode series with the filament so that only alternate half cycles of the supply voltage are applied to the filament. This has the effect of reducing the time average value of voltage to about 0.7 of that produced by the unrectified supply voltage. Consequently, the filament is operated at a substantially lower temperature and also at a lower efficiency in terms of lumens per watt. The following patents describe the use of a rectifying diode in series with the filament of an incandescent lamp, the diode being installed in a socket for a lamp:

| | | | |
|---|---|---|---|
| Muneson | 3,450,893 | Beining | 3,963,956 |
| Borneman | 3,823,339 | | |

The following patents describe incandescent lamps with a diode incorporated into the structure of the lamp:

| | |
|---|---|
| Pearson | 3,148,305 |
| Anderson et al | 3,869,631 |

One difficulty encountered in the use of a diode for extending lamp life is that the reduction of effective voltage without a change in the filament design results in large decrease in filament temperature and the light output of the lamp is substantially diminished. Operation at the reduced temperature also results in lower efficiency of the filament. For example, the standard 100 watt lamp mentioned above has an operating temperature of 2577° C. without a diode and the light output is 1750 lumens. With a diode in this lamp in series with the filament, the operating temperature is reduced to 2164° C. and the light output is 510 lumens. The diode has the effect of reducing power consumption of the lamp from 100 watts to 58.8 watts. The average life for the lamp without the diode is 750 hours and the same lamp with a diode is 8.6 years.

The Anderson et al patent cited above attempts to overcome the disadvantages of an incandescent lamp with a diode in series with the filament. The lamp of this patent utilizes a filament made of tungsten wire having a weight of about 50 percent greater than is normally used for the particular lamp under consideration. The lamp is operated at a filament temperature of at least 2600° K. According to the patent, this modification of the lamp restores it to its rated wattage and improves the efficiency in terms of lumens per watt, as compared with the lamp having an unmodified filament and a diode in circuit with the filament.

In the prior art, it is known to use a heat reflector for the purpose of reflecting infrared radiation back to the filament to reduce the energy loss in lamp operation. Such arrangements are described in the following patents:

| | |
|---|---|
| Hoffman | 1,425,967 |
| Freeman | 3,209,188 |
| Florington et al | 4,160,929 |

In the lamps described in these patents, the envelope is provided with a layer of material which is substantially transparent for visible light and highly reflective for infrared energy. The Florington et al patent is of great interest in that it discloses a shield of reflective material mounted on the stem of the lamp for the purpose of reflecting infrared energy back to the filament.

A general object of this invention is to overcome certain disadvantages of the prior art and to provide an improved incandescent lamp having an extended operating life and increased efficiency.

SUMMARY OF THE INVENTION

In accordance with this invention, there is provided an improved incandescent lamp having an extended life with a high value of operating efficiency. This is accomplished by utilizing a rectifying diode in series with a tungsten filament and disposed adjacent the base of the lamp, with a reflector for visible light in the envelope between the filament and the base of the lamp. The reflector is preferably supported on the stem of the lamp adjacent the junction of the bulb portion and neck portion of the envelope to substantially close the passageway therebetween for minimizing convection currents in the neck of the envelope. The diode is disposed between the reflector and the base of the lamp and is shielded by the reflector from the higher temperature of the bulb. Extended life and high efficiency in terms of lumens per watt are achieved with an operating temperature of the tungsten filament below approximately 2550° C.

Preferably, the reflector comprises a convex surface of revolution facing the filament for reflectively dispersing the visible light outwardly through the bulb of the envelope. Preferably the reflector is a unitary sheet metal cup-shaped body and the surface of revolution is parabolic in cross-section. Further, it is preferred to fill the lamp envelope with a mixture of krypton and argon gases at subatmospheric pressure.

A more complete understanding of this invention may be obtained from the detailed description that follows taken with the accompanying drawings.

BEST MODE FOR CARRYING OUT THE INVENTION

Figure 1:
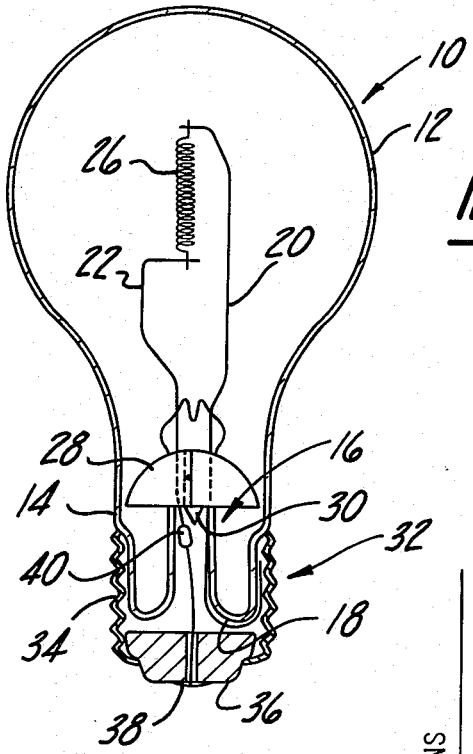
FIG. 1 is an elevational view, partially in section, of the incandescent lamp of this invention.

Referring now to the drawings, there is shown an illustrative embodiment of the invention in an incandescent lamp of the so-called A-line lamps which are commonly used for home lighting. The lamp comprises a glass envelope 10 including a bulb portion 12 and a neck portion 14. The envelope is completed by the conventional stem press glass mount, referred to herein as the stem 16, the flare 18 of which joined with the neck portion 14. The lamp includes a pair of lead-in wires 20 and 22 which extend through the stem 16. A coiled tungsten filament 26 is supported between the ends of the lead-in wires 20 and 22.

A reflector 28 is supported on the stem 16 and is disposed in the passageway between the bulb portion 12 and the neck portion 14. The reflector 28 has a convex surface of revolution which is reflective to the visible light from the filament 26 which would otherwise impinge upon and be dissipated as a loss in the neck and base of the lamp. The reflector 28 has the form of a skirt with a parabolic cross-section. It is preferably constructed of sheet metal, suitably aluminum, by stamping and drawing to form a skirt with an open side. The reflector is suitably mounted on the stem (before insertion of the stem into the envelope) by wrapping the skirt around the stem so that the free edges overlap and spot welding the edges. The outer rim of the reflector has a diameter which is only slightly less than the inside diameter of the neck 14 so there is little clearance therebetween. This arrangement is effective to block convection currents between the bulb portion and the neck portion and thus to minimize the heat loss through the base of the lamp.

The lamp is filled with a gaseous mixture according to known practice. Preferably, it comprises a mixture which is known to enhance lamp efficiency such as krypton and argon at subatmospheric pressure. The mixture preferably comprises about 85 percent krypton and about 15 percent argon. The gas filling of the envelope is accomplished through the exhaust tube 30, shown in its sealed or tipped-off condition.

The lamp is provided with a conventional screw base 32 attached to the neck portion of the envelope. The base comprises a threaded metal sleeve 34, an insulator plug 36 and a center metal contact 38. The base is adapted to be received in a conventional lamp socket through which a supply voltage, nominally 120 volts AC, 60 cycle, is applied across the center contact 38 and the sleeve 34.

The lead-in wire 20 is connected directly to the sleeve 34. The lead-in wire 22 is connected through a diode 40 to the center contact 38. Thus, the filament 26 and the diode 40 are connected in series between the center contact and the sleeve 34. The orientation of the diode, i.e. its polarity in the circuit, is immaterial.

The diode 40 is a silicon diode, suitably a IN4003 having a peak inverse voltage rating of 400 volts and a current rating of about one ampere. The diode has a glass encapsulation and is rated for operating temperature of 260° F. at its leads. The diode is disposed adjacent the base, remote from the heat of the filament 26 and the reflector 28 is effective to block the convection currents generated by the heat of the filament. Thus, the diode 40 is disposed in a relatively cool portion of the lamp and operates at a temperature conducive to reliability and long life.

The filament 26 is of such wire size and configuration that the lamp operates at its rated wattage with a filament operating temperature less than about 2550° C. At this temperature, the lamp has an extended operating life with good efficiency in terms of lumens per watt.

Figure 2:
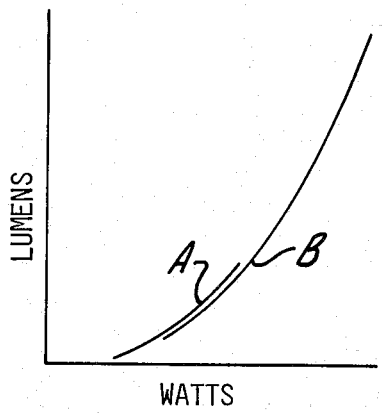
FIGS. 2 and 3 are graphical representations to aid in the explanation of this invention.
Figure 3:
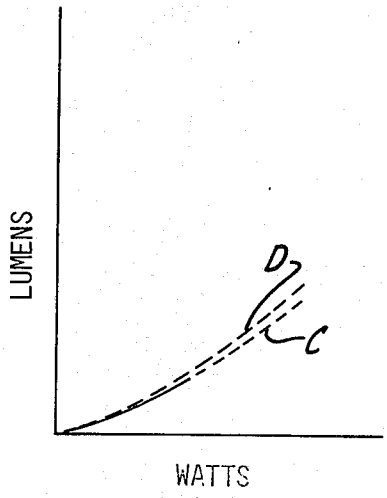

In operation, the diode 40 functions to rectify the supply voltage so that the filament is energized on alternate half-cycles, i.e. with a succession of unidirectional pulses. For a given input power, the lamp produces a higher value of lumens per watt than the same lamp without a diode. This relationship is illustrated in FIG. 2 wherein curve A represents a lamp with a diode and curve B represents the same lamp without a diode. The reflector 28 is effective to increase operating efficiency by reflective dispersal of visible light through the bulb portion of the envelope which otherwise would be dissipated in the neck portion of the envelope. Further, efficiency is increased because the reflector 28 blocks convection currents so that heat loss through the base of the lamp is minimized. This maintains the operating temperature of the diode 40 at a reduced value for long life and reliability. The beneficial effect of the reflector is depicted in FIG. 3 which shows lamp output in lumens as a function of lamp input in watts. Curve C represents a lamp with a diode but no reflector and Curve D represents a lamp with a diode and reflector. Curve E represents a "standard lamp", i.e. no diode or reflector. Although the description of this invention has been given with reference to a particular embodiment, it is not to be construed in a limiting sense. Many variations or modifications of the invention will now occur to those skilled in the art. For a definition of the invention reference is made to the appended claims.

What is claimed is:

1. In an incandescent lamp of the type comprising:

a glass envelope including a bulb portion, a neck portion and a stem, a screw base including a metal sleeve, an insulating base plug therein and a metal center contact in the insulating plug, a pair of lead-in wires extending through the stem, one of the lead-in wires being electrically connected to said center contact and the other being electrically connected to said sleeve, a wire filament disposed within said envelope and connected between said pair of lead-in wires, the improvement comprising:

a diode electrically connected bewtween one of said lead-in wires and one of said base contacts and being disposed in said neck portion of the envelope adjacent said base, and a reflector supported on said stem adjacent the junction of said bulb portion and said neck portion and substantially closing the passageway between the bulb portion and the neck portion for reducing convection currents therebetween whereby heat loss through said base is reduced, said reflector being disposed between said diode and said filament whereby said diode is shielded from the heat of said filament for operation at reduced temperature.

2. The invention as defined in claim 1 wherein said filament has an operating temperature below approximately 2550° C.

3. The invention as defined in claim 1 wherein said reflector comprises a convex surface of revolution facing said filament, said surface being highly reflective to visible light.

4. The invention as defined in claim 3 wherein said reflector is a sheet metal skirt supported on said stem.

5. The invention as defined in claim 3 or 4 wherein said convex surface of revolution is parabolic in cross-section.

6. The invention as defined in claim 3 wherein said envelope is filled with a mixture of krypton and argon gases at subatmospheric pressure.

* * * * *